US005394818A

United States Patent [19]

Walker, II et al.

[11] Patent Number: 5,394,818

[45] Date of Patent: Mar. 7, 1995

[54] ANCHOR STOWAGE APPARATUS

[76] Inventors: Murphy L. Walker, II, 6030 Ocean Dr., Corpus Christi, Tex. 78412; Randall L. Wendel, 4506 Moonlake Ridge Dr., Corpus Christi, Tex. 78413

[21] Appl. No.: 198,876

[22] Filed: Feb. 18, 1994

[51] Int. Cl.[6] ..... B63B 21/24

[52] U.S. Cl. ..... 114/294

[58] Field of Search ..... 114/210, 343, 364, 293, 114/294; 43/21.2; 248/538, 539, 520, 530, 532, 533

[56] References Cited

U.S. PATENT DOCUMENTS

| | | | |
|---|---|---|---|
| 3,106,181 | 10/1963 | Dare | 114/210 |
| 3,139,252 | 6/1964 | Mann | 248/538 |
| 3,745,690 | 7/1973 | Lewis | 43/21.2 |
| 4,164,194 | 8/1979 | Kurz | 114/210 |
| 4,515,335 | 5/1985 | DeRosett | 114/364 |
| 5,065,540 | 11/1991 | Potter, Jr. | 43/21.2 |

OTHER PUBLICATIONS

Boat/U.S.-1994 Annual Equipment Catalog-Excerpt.
M & E Marine-1994 Catalog-Excerpt.
Goldberg's Marine-1994 Catalog-Excerpt.
Anchors and Anchoring, R. D. Ogg, 8th Ed.-Excerpt.
Piloting Seamanship And Small Boat Handling, C. S. Chapman-Excerpt.

*Primary Examiner*—Edwin L. Swinehart
*Attorney, Agent, or Firm*—George S. Gray

[57] ABSTRACT

An apparatus for stowing a "Danforth" type anchor and rode, comprising a frame with two vertical slots for receiving and supporting the anchor's stock ends, flukes, and shank. The frame is shaped such that the rode can also be supported and suspended above the deck. After a simple operation, the anchor and rode are stowed in a secure, upright, and compact manner. Provisions are also available for draining liquids from the interior of the apparatus, as well as, for protecting the deck from scratches and abrasions which might otherwise result from contact with the apparatus during use.

19 Claims, 3 Drawing Sheets

ANCHOR STOWAGE APPARATUS

BACKGROUND

Our invention relates generally to the use and stowage of boating anchors and rode. Our invention is particularly responsive to the needs of boaters using a stock-stabilized, pivoting fluke anchor, commonly referred to as "Danforth" type anchors, although many anchor types exist within the "Danforth" category.

These anchors typically have a shank with a means for attaching the rode at the top end and a stock, a crown, and flukes at the other, the stock acting as a pivot bar for pivotal movement of the crown and flukes with respect to the shank over a limited range. The rode normally consists of one end of a length of chain attached to the top end of the shank, with rope being attached to the other end of the chain.

When in use the rope is normally tied off to one or more locations on the boat. When retrieving the anchor the rope is ordinarily brought aboard first, followed by the chain, with the shank being the first portion of the anchor accessible by the boater.

These anchors are in widespread use on non-industrial boats of smaller size, for which deck space is at a premium. Upright stowage of the anchor, and compact stowage of the chain and rope, contribute to efficient use of limited deck space. Flexibility in choice of stowage locations also contributes to such efficiency.

In many instances a significant volume of debris, including mud, will remain on various parts of the anchor after use, particularly on the crown, flukes and stock. Anchor stowage equipment which can function in the presence of such debris is highly desirable, particularly if the boater is able to perform the stowage operation while handling only the top end of the shank, without the necessity of handling the crown, flukes or stock. Washability during stowage is also a valuable attribute of the equipment.

A significant aspect of these anchors is the noise and the potential boat or equipment damage that can result if movement of the anchor or its components is allowed to occur relative to either the boat or other anchor components. Lack of significant anchor component movement during stowage is a positive feature of a stowage system.

It is a common event for boaters to find themselves operating in rough waters and other situations where it is desirable that activities on the boat be performable in the most simple and straightforward manner possible. Anchor stowage is such an activity, and it is significantly simplified if it can be performed in the absence of separate bindings, Hooks, locks, etc. and without inversion or precise placement of anchor components.

As with all marine equipment, salt water corrosion is a continuing problem for many anchor stowage devices.

Aesthetics are an important part of modern pleasure boating, with a large amount of attention paid to stylistic features of the boat and its equipment, by both the manufacturer and the owner. Boat equipment which performs its function and also conceals less aesthetically pleasing boat equipment is highly desirable, particularly if the former is itself stylistically adaptable to the boat's decor.

For non-corrodible the foregoing reasons, there is a need for boat equipment which provides for stowage of the anchor, chain, and rope, in a secure, upright, compact, and stylistically adaptable manner, and, further, which is simple to use, even in the presence of debris, or while operating in rough waters.

SUMMARY

Our invention is directed to an apparatus that satisfies the need for non-corrodible boat equipment which provides for stowage of the anchor, chain, and rope, in a secure, upright, compact, and stylistically adaptable manner, and, further, which is simple to use, even in the presence of debris, or while operating in rough waters. The apparatus comprises a hollow frame, the frame having an open top and a pair of opposed slots, each of the slots having a closed end and an open end, the open end coinciding with the top end of the frame. The top end frame opening and the interior passage are shaped for receiving the crown of the anchor and allowing movement of the crown through the interior passage. The slots are shaped and positioned on the frame for simultaneously receiving one of the anchor stock's ends in each slot and allowing movement of the stock ends from the open ends of the slots to the closed ends of the slots. The difference in magnitudes of the vertical length of the frame and the lengths of the slots is such that the anchor is fully suspended above the surface below when the stock ends bear upon the closed ends of the slots. The insertion of the stock ends into the slots is a simple operation which can ordinarily be performed even in the presence of debris on the anchor components.

The top end opening and interior passage can also be shaped to receive portions of the anchor chain and anchor rope, such that the chain and rope are fully suspended from the surface below when the anchor is stowed, i.e. when its stock ends bear upon the closed ends of the slots. This allows for compact and secure stowage of the chain and rope and provides a vertical restraining force on the anchor.

The distance between the slots can be chosen such that it is slightly less than the distance between the outermost edges of the two anchor flukes, as measured along the stock. When this is the case the slots force the flukes into a substantially upright position.

Our invention can also include a means for draining liquids from the interior passage when the frame has a closed end or when it is mounted flush to the surface on which the apparatus is positioned.

A means for protecting the surface below the apparatus from scratches and abrasions due to contact with the bottom end of the apparatus can also be included.

Additionally, a means for a simple attachment of the apparatus to vertical or horizontal surfaces can be included using well known attachment hardware.

DESCRIPTION OF THE DRAWINGS

These and other features, aspects, and advantages of the present invention will become better understood with regard to the following description, appended claims, and accompanying drawings where.

DESCRIPTION

Figure 1:
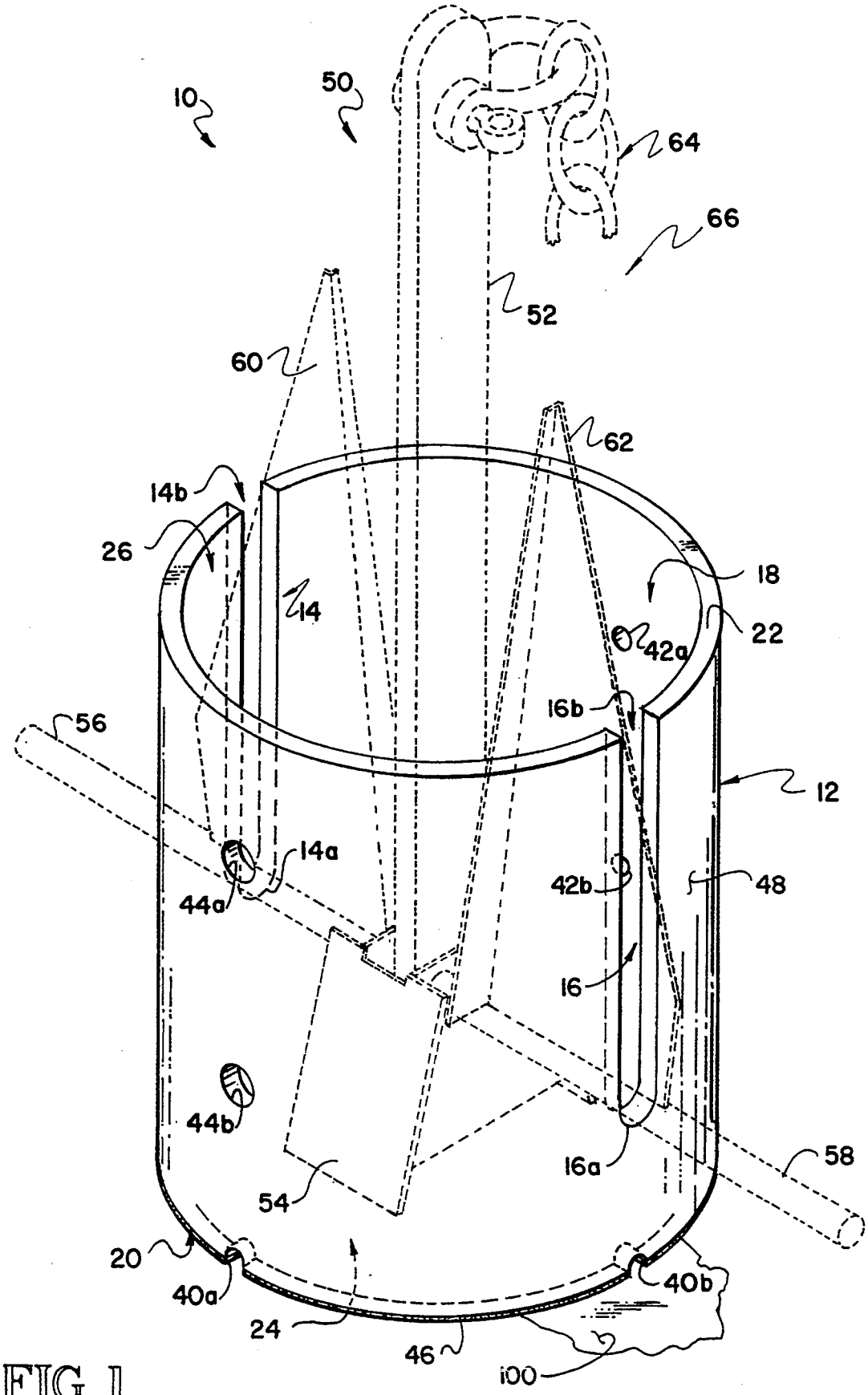
FIG. 1 shows a perspective view of the apparatus with the anchor in its stowed position, but not the anchor chain and anchor rope.
Figure 2:
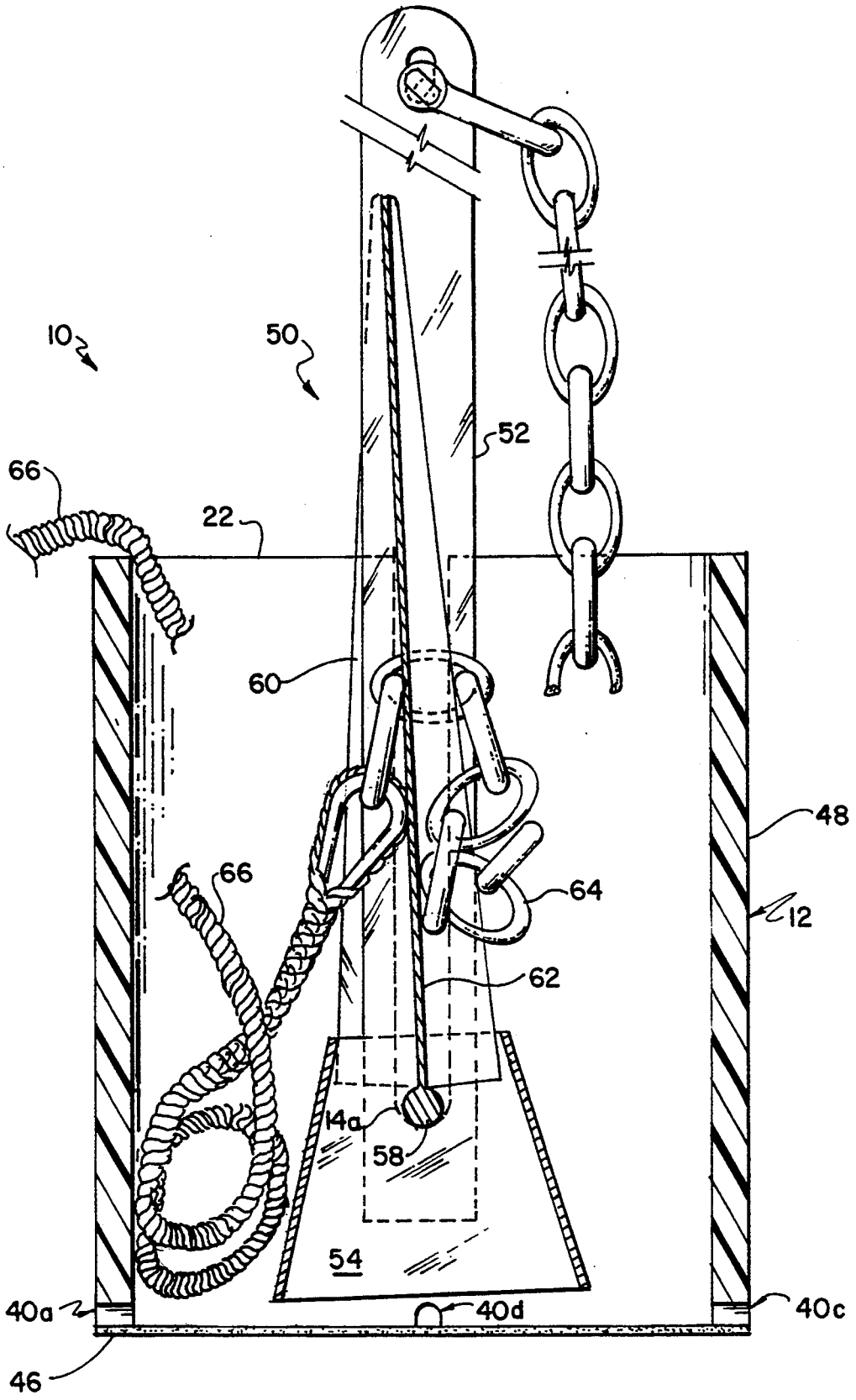
FIG. 2 shows a sectional view of the same apparatus shown in FIG. 1, with the anchor, anchor chain, and anchor rope stowed.

Our invention is an anchor stowage apparatus 10, the preferred embodiment of which is shown in FIGS. 1–2. The actual dimensions of the apparatus depend upon the size of the anchor 50, however, the relative dimensions of the apparatus, anchor 50, chain 64, and rope 66 are accurate as depicted in FIGS. 1–2. The preferred embodiment of our invention comprises a frame 12, the frame 12 being radial along its vertical length and having a vertical pair of slots, the pair having a first slot 14 and a second slot 16. The frame also an interior passage 18, a bottom end 20, a bottom end opening 24, a top end 22, and a top end opening 26. The first slot 14 has a closed end 14*a* and an open end 14*b* and the second slot 16 has a closed end 16*a* and an open end 16*b*, the open ends 14*b*, 16*b* of both coinciding with the top end 22. In this embodiment the first and second slots 14, 16 are straight, have rounded closed ends 14*a*, 16*a*, and are diametrically opposed on the frame.

As shown in FIG. 1 the frame 12 also has a drainage means for liquid drainage from the interior passage, comprising four half-circle holes 40 drilled with the full-circle center point of each coinciding with the bottom end of the frame 12, the four drainage holes 40 being equally spaced along the circumference of the bottom end 20.

As shown further in FIG. 1 the frame 12 in this embodiment also has two circular holes 42*a*, 42*b* in the frame 12 for attachment to horizontal or vertical boat surfaces 100, using well known attachment hardware such as bolts, screws, and angled brackets. The frame 12 here also has installation access holes 44*a*, 44*b* corresponding to each of the attachment holes 42*a*, 42*b*, located on the opposite side of the frame 12.

More particularly the frame 12 in the preferred embodiment is made of Schedule 80 polyvinyl chloride pipe. The nominal pipe diameter is chosen such that it is slightly less than the distance between the outermost edge of the first anchor fluke 60 and the outermost edge of the second anchor fluke 62 when measured along the length of the anchor stock 57. It is also a function of the amount of annular space required to receive portions of the anchor chain 64 and the anchor rope 66 as illustrated in FIG. 2, such that the anchor chain 64 and rope 66 are supported and suspended by the apparatus above the surface 100 beneath the apparatus. Nominal wall thickness was chosen based on experimental use verifying that the thickness shown in FIGS. 1–2 was sufficient to support and secure the anchor 50, chain 64, and rope 66 during actual marine operations.

The vertical length of the frame 12 is dictated by the relationship between the vertical lengths of the slots 14, 16 and the vertical length of the frame 12, the required relationship being such that the lowermost point of the anchor crown 54 is suspended above the surface 100 beneath the apparatus when the anchor 50 is stowed, i.e. when the first and second stock ends 56, 58 bear upon the first and second closed ends 14*a*, 16*a* of the first and second slots 14, 16.

In this embodiment the width of the slots 14, 16 was chosen on the basis of providing sufficient clearance for the stock ends 56, 58, leaving only a nominal amount of clearance as the stock ends 56, 58 move through the slots 14, 16.

FIG. 1 illustrates the surface protection means which in this embodiment is comprised of a layer of rubber 46 attached to the bottom end 20 surfaces which contact the surface 100 beneath the apparatus.

The stowage operation with respect to the preferred embodiment of our invention consists of guiding the anchor stock's first and second ends 56, 58 into the open ends 14*b*, 16*b* of the first and second slots 14, 16, and allowing the stock ends 56, 58 to move through the slots 14, 16 until the stock ends 56, 58 bear upon the closed ends 14*a*, 16*a* of the slots 14, 16. At this point the first and second anchor flukes 60, 62 are held in a substantially upright position by the first and second slots 14, 16, the crown 54 is suspended above the normally horizontal boat surface, and the shank 52 is held in a generally upright position by the pivoting limits of the anchor 50 itself. If desired portions of the chain 64 and rope 66 may then be placed in the space remaining on either side of the upright flukes 60, 62 within the interior passage 18 as shown in FIG. 2.

Inserting the stock ends 56, 58 into the slots 14, 16, as described above, and as depicted in FIGS. 1–2, is essentially a one-handed operation and can be accomplished even in the presence of significant amounts of debris on the anchor 50 components. Such debris often complicates the placement of an anchor in some current anchor holder devices, e.g. chocks. In this embodiment, however, the open ends 14*b*, 16*b* of the slots 14, 16 tend to cut through debris on the stock ends 56, 58 and flukes 60, 62. Furthermore, since the slots 14, 16 support the flukes 60, 62 in a substantially upright position, the shank 52, which has only a limited pivot range with respect to the flukes 60, 62, is also supported satisfactorily with no further handling. This eliminates the necessity of a separate operation to secure the shank 52 which is required in the two piece anchor bracket illustrated in U.S. Pat. No. 4,164,194. It also eliminates the need for inconvenient manipulation of separate bindings which are required on some current devices.

Placing the chain 64 and rope 66 in the annular spaces remaining after anchor 50 placement provides for compact stowage of the chain 64 and rope 66, as well as providing vertical resistance to upward motion of the anchor 50 in the slots 14, 16. Additionally, the desired angle of the shank 52 during stowage can easily be achieved by positioning the shank 52 prior to the placement of the chain 64 and rope 66. No anchor stowage devices are known which provide upright anchor 50 stowage with on-deck, compact stowage of the chain 64 and rope 66.

The drainage holes 40 allow the anchor 50, chain 64, and rope 66, to be washed while stowed in the apparatus, with water and debris exiting through the drainage holes 40.

An additional advantage of our invention is the stylistic adaptability of the apparatus. The apparatus has a significant amount of external surface area 48 which can be decoratively colored in a manner compatible with its surroundings, and its configuration conceals a substantial amount of boat equipment.

Our invention is adaptable to numerous installation locations. Attachments are easily accomplished using well known attachment hardware, such as bolts, screws, and angled brackets.

Figure 3:
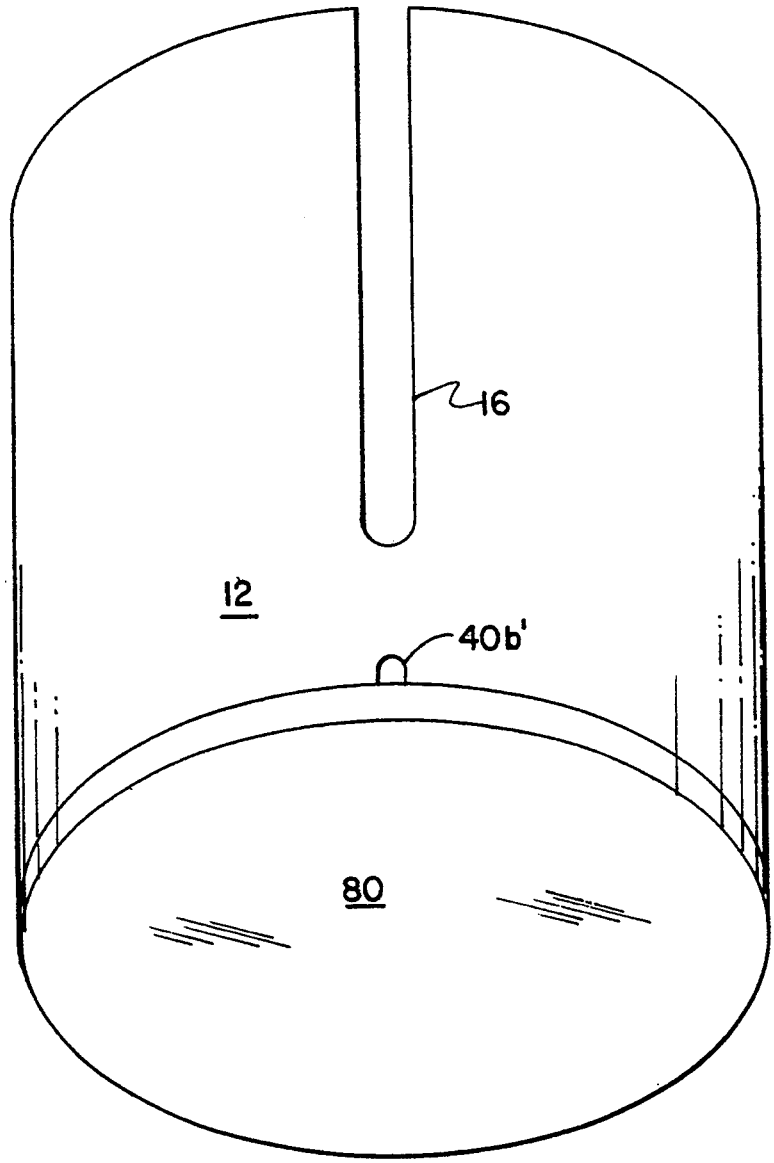
FIG. 3 shows a perspective view of the bottom portion for an embodiment in which the bottom end is closed.

In an alternative embodiment of our invention the bottom end opening is removed and the frame has a closed bottom end 80, as shown in FIG. 3, which prevents anchor components from extruding through the bottom end 20 of the frame 12. The closed bottom end 80 can be made of the same material as the frame 12, described above.

Although the present invention has been described in considerable detail with reference to certain preferred and alternate embodiments thereof, other embodiments are possible. Accordingly, the spirit and scope of the appended claims should not be limited to the description of the embodiments contained herein.

We claim:

1. An apparatus for anchor stowage, the apparatus comprising:

a frame having an interior passage, the frame further having a bottom end and a top end, the top end having an opening, the top end opening, bottom end, and interior passage being shaped for receiving the crown of an anchor through the top end opening, and allowing movement of the crown through the interior passage;

the frame further having anchor stock supporting means comprising a pair of slots, the pair having a first slot and a second slot, the first and second slots each having an open end and a closed end, the open end of each slot being at the top end opening of the frame;

the first and second slots being shaped for closely receiving the anchor stock's first and second ends, the first and second slots being further shaped and positioned on the frame for simultaneously receiving the anchor stock's first and second ends, respectively, and allowing movement of the first and second ends of the anchor stock from the open ends of the first and second slots to the closed ends of the first and second slots;

the difference in the respective magnitudes of the vertical length of the frame and the lengths of the first and second slots in the pair being such that the anchor is fully suspended above the surface beneath the apparatus.

2. The apparatus of claim 1, wherein the bottom end of the frame further comprises an opening in the bottom end, the bottom end opening being centered upon the vertical axis of the frame, the bottom end opening being a continuation of the interior passage through the frame.

3. The apparatus of claim 2, wherein the frame is further shaped such that the distance between the first and second slots in the pair is less than the distance from the outermost edge of the first anchor fluke to the outermost edge of the second anchor fluke, the latter distance being measured along the anchor stock.

4. The apparatus of claim 2, further comprising:

a non-abrasive material attached to the bottom end of the frame, the non-abrasive material being attached such that the frame is displaced from contact with the underlying surface being borne upon by the apparatus.

5. The apparatus of claim 2, further comprising:

drainage means for allowing liquids to fully drain from the interior passage of the frame, without draining through the bottom end opening.

6. The apparatus of claim 2, wherein the top end opening and the interior passage are further shaped for receiving a portion of each of the anchor chain and anchor rope, such that the frame fully suspends the anchor chain and anchor rope above the surface beneath the apparatus.

7. The apparatus of claim 6, wherein the frame is further shaped such that the distance between the first and second slots in the pair is less than the distance from the outermost edge of the first anchor fluke to the outermost edge of the second anchor fluke, the latter distance being measured along the anchor stock.

8. The apparatus of claim 7, further comprising:

drainage means for allowing liquids to fully drain from the interior passage of the frame, without draining through the bottom end opening.

9. The apparatus of claim 8, further comprising:

a non-abrasive material attached to the bottom end of the frame, the non-abrasive material being attached such that the frame is displaced from contact with the underlying surface being borne upon by the apparatus.

10. The apparatus of claim 9, wherein the frame is constructed of material which is non-corrodible in a salt water environment.

11. An apparatus for anchor stowage, the apparatus comprising:

(a) a frame having an interior passage, the frame further having a bottom end and a top end, the top end having an opening, the bottom end having means for preventing extrusion of any anchor components through the bottom end;

the top end opening, bottom end, and interior passage being shaped for receiving the crown of an anchor through the top end opening, and allowing movement of the crown through the interior passage;

the frame further having anchor stock supporting means comprising a pair of slots, the pair having a first slot and a second slot, the first and second slots each having an open end and a closed end, the open end of each slot being at the top end opening of the frame;

the first and second slots being shaped for closely receiving the anchor stock's first and second ends, the first and second slots being further shaped and positioned on the frame for simultaneously receiving the anchor stock's first and second ends, respectively, and allowing movement of the first and second ends of the anchor stock from the open ends of the first and second slots to the closed ends of the first and second slots;

the difference in the respective magnitudes of the vertical length of the frame and the lengths of the first and second slots in the pair being such that the anchor is fully suspended above the bottom end; and (b) drainage means for allowing liquids to fully drain from the interior passage of the frame.

12. The apparatus of claim 11, further comprising:

a non-abrasive material attached to the bottom end of the frame, the non-abrasive material being attached such that the frame is displaced from contact with the underlying surface being borne upon by the apparatus.

13. The apparatus of claim 11, wherein the frame is further shaped such that the distance between the first and second slots in the pair is less than the distance from the outermost edge of the first anchor fluke to the outermost edge of the second anchor fluke, the latter distance being measured along the anchor stock.

14. The apparatus of claim 11, wherein the top end opening and the interior passage are further shaped for receiving a portion of each of the anchor chain and anchor rope, such that the frame fully suspends the anchor chain and anchor rope above the surface beneath the apparatus.

15. The apparatus of claim 14, wherein the frame is further shaped such that the distance between the first and second slots in the pair is less than the distance from the outermost edge of the first anchor fluke to the outermost edge of the second anchor fluke, the latter distance being measured along the anchor stock.

16. The apparatus of claim 15, further comprising:

a non-abrasive material attached to the bottom end of the frame, the non-abrasive material being attached such that the frame is displaced from contact with the underlying surface being borne upon by the apparatus.

17. The apparatus of claim 16, wherein the frame is constructed of material which is non-corrodible in a salt water environment.

18. An apparatus for anchor stowage, the apparatus comprising:

a frame having an interior passage, the frame further having a bottom end and a top end, the top end having an opening, the top end opening, bottom end, and interior passage being shaped for receiving the crown of an anchor through the top end opening, and allowing movement of the crown through the interior passage;

the frame further having anchor stock supporting means comprising a pair of slots the pair having a first slot and a second slot, the first and second slots each having an open end and a closed end, the open end of each slot being at the top end opening of the frame;

the first and second slots being shaped for closely receiving the anchor stock's first and second ends, the first and second slots being further shaped and positioned on the frame for simultaneously receiving the anchor stock's first and second ends, respectively, and allowing movement of the first and second ends of the anchor stock from the open ends of the first and second slots to the closed ends of the first and second slots.

19. The apparatus of claim 18, wherein the frame is further shaped such that the distance between the first and second slots in the pair is less than the distance from the outermost edge of the first anchor fluke to the outermost edge of the second anchor fluke, the latter distance being measured along the anchor stock.

* * * * *